US011105337B2

(12) United States Patent
Kim et al.

(10) Patent No.: US 11,105,337 B2
(45) Date of Patent: Aug. 31, 2021

(54) AXIAL FLOW FAN

(71) Applicant: Hanon Systems, Daejeon (KR)

(72) Inventors: Myung Hoon Kim, Daejeon (KR); Kyung Seok Cho, Daejeon (KR)

(73) Assignee: Hanon Systems, Daejeon (KR)

( * ) Notice: Subject to any disclaimer, the term of this patent is extended or adjusted under 35 U.S.C. 154(b) by 0 days.

(21) Appl. No.: 16/468,973

(22) PCT Filed: Dec. 28, 2017

(86) PCT No.: PCT/KR2017/015644

§ 371 (c)(1),
(2) Date: Jun. 12, 2019

(87) PCT Pub. No.: WO2018/124773

PCT Pub. Date: Jul. 5, 2018

(65) Prior Publication Data

US 2019/0309766 A1 Oct. 10, 2019

(30) Foreign Application Priority Data

Dec. 28, 2016 (KR) ..... 10-2016-0180841

(51) Int. Cl.

| | |
|---|---|
| ***F04D 29/38*** | (2006.01) |
| ***F04D 19/00*** | (2006.01) |
| ***F04D 29/66*** | (2006.01) |

(52) U.S. Cl.

CPC ..... *F04D 29/384* (2013.01); *F04D 19/00* (2013.01); *F04D 19/002* (2013.01); *F04D 29/38* (2013.01); *F04D 29/66* (2013.01)

(58) Field of Classification Search

CPC ..... F04D 29/384; F04D 19/00; F04D 19/002; F04D 29/38; F04D 29/66; F04D 29/326;
(Continued)

(56) References Cited

U.S. PATENT DOCUMENTS 5,603,607 A 2/1997 Kondo et al.

FOREIGN PATENT DOCUMENTS

CN 1189880 A 8/1998
KR 100250165 B1 4/2000
(Continued)

OTHER PUBLICATIONS

Machine Translation of KR101408917B1 [retrieved on Jul. 10, 2020]. Retrieved from: Espacenet. (Year: 2020).*
(Continued)

*Primary Examiner* — J. Todd Newton
*Assistant Examiner* — Eric J Zamora Alvarez
(74) *Attorney, Agent, or Firm* — Norton Rose Fulbright US LLP; James R. Crawford

(57) ABSTRACT

The present invention relates to an axial flow fan and, more particularly, to an axial flow fan comprising: a hub; and a plurality of blades that are disposed radially on the circumference of the hub such that roots of the blades are coupled to the hub, wherein the blades are formed so as to have a waveform shape such that a position of a trailing edge gradually approaches and recedes from a leading edge repeatedly, the trailing edge is positioned on the same plane, and an installation angle changes in the lengthwise direction of the blades.

4 Claims, 9 Drawing Sheets

(58) Field of Classification Search
CPC ..... F04D 29/329; F04D 29/325; F05D 2240/304; F05D 2240/122; F05D 2250/184; F05D 2250/611; F05B 2240/301; F05B 2250/182; F05B 2250/73
See application file for complete search history.

(56) References Cited

FOREIGN PATENT DOCUMENTS

| | | | |
|---|---|---|---|
| KR | 100753024 | B1 | 8/2007 |
| KR | 20090039102 | A | 4/2009 |
| KR | 101408917 | B1 | 6/2014 |
| WO | 2009054815 | A1 | 4/2009 |

OTHER PUBLICATIONS

International Search Report issued in PCT/KR2017/015644 dated Apr. 5, 2018.

* cited by examiner

AXIAL FLOW FAN

This patent application is a national phase under 35 U.S.C. § 371 of International Application No. PCT/KR2017/0015644 filed Dec. 28, 2017, which claims priority from Korean Patent Application No. 10-2016-0180841, filed Dec. 28, 2016 each of which is hereby incorporated herein by reference in its entirety for all purposes.

TECHNICAL FIELD

The present invention relates to an axial flow fan, and more particularly, to an axial flow fan including a hub, and a plurality of blades disposed radially on a circumference of the hub and having blade muscles coupled to the hub, wherein the blades are formed so that a position of a trailing edge thereof has a waveform shape that gradually repeats retraction and advancement from a leading edge thereof, the trailing edge thereof is positioned on the same plane, and a setting angle thereof is changed toward a longitudinal direction of the blades.

BACKGROUND ART

An axial flow fan is provided to be generally accommodated in a fan shroud, a motor or the like for rotating the axial flow fan is fixed to the fan shroud, and the fan shroud is mounted and a portion thereof is fixed.

As described, an axial flow fan assembly including the axial flow fan, the fan shroud, the motor, and the like is mounted on a heat exchanger or a bottom of an engine room so as to be disposed in front of or behind the heat exchanger.

FIG. 1 shows an embodiment of an arrangement of a heat exchanger and an axial flow fan assembly.

As shown in FIG. 1, an axial flow fan 10 is disposed in parallel to heat exchangers 20, such as a radiator 21 and a condenser 22 in an air blowing direction so as to cause forced convection of air, thereby making a flow of air to a core of the heat exchangers 20 smooth.

FIG. 2 is a view illustrating a conventional air flow fan.

As shown in FIG. 2, the air flow fan 10 is formed to include a hub 12, and a plurality of blades 11 disposed radially on a circumference of the hub 12.

A fan band 13 for connecting the plurality of blades 11 to each other may be further provided to a blade end 11*a* side of the blades 11.

As described above, since the axial flow fan 10 is for causing forced blowing to smooth a flow of air passing through the heat exchanger, it is very important to design the shape of the blades 11 for increasing blowing efficiency.

Meanwhile, in a conventional blade shape design research, most of research was conducted to increase an air volume, and since the increase in the blowing efficiency is directly related to enhancement of a heat exchange performance in the heat exchanger, a main object of most of the blade shape design research was to increase the air volume.

In this case, in order to maximize the heat exchange performance in the heat exchanger, it is important not only to increase the air volume but also to optimize the air volume to be distributed and blown to an entire area of the heat exchanger.

Further, since automobiles have been used by many people as everyday necessities in recent years, research is being actively carried out to provide a more comfortable driving feeling to a driver and passengers of the automobile.

One of these researches is a research for reducing noise, and the noise generated from the axial flow fan is continuously reduced to improve competitiveness of a product.

DISCLOSURE

Technical Problem

An object of the present invention is to provide an axial flow fan including a hub, and a plurality of blades disposed radially on a circumference of the hub and having blade muscles coupled to the hub, and capable of not only reducing an occurrence of noise due to an operation of the axial flow fan, but also reducing power consumption by deforming a shape of the blades.

Technical Solution

In one general aspect, an axial flow fan includes a hub, and a plurality of blades disposed radially on a circumference of the hub and having blade muscles coupled to the hub, wherein a radial direction of the axial flow fan is defined as a longitudinal direction, a length obtained by connecting a leading edge and a trailing edge of the blade is defined as a chord length L, and an angle formed with a horizontal plane of the axial flow fan at the trailing edge of the blade is defined as a setting angle $\alpha$, and the blade has a waveform form in which a position of the trailing edge gradually repeats a retraction and an advancement from the leading edge toward the longitudinal direction, such that the position and the setting angle $\alpha$ of the trailing edge are continuously changed toward the longitudinal direction.

The chord length L of the blade may be continuously changed toward the longitudinal direction.

The leading edge and the trailing edge of the blade may have positions that are continuously changed toward the longitudinal direction.

The blade may be formed so that the waveform form of the trailing edge is repeated at least twice or more toward the longitudinal direction.

The blade may be formed so that the trailing edge is retracted and advanced in the range between 6 mm and 8 mm from the leading edge.

The blade may be formed so that the trailing edge is positioned on the same plane in the longitudinal direction in the hub.

The axial flow fan may further include a fan band formed in a ring form and connecting the respective blade ends of the blades to each other.

Advantageous Effects

The axial flow fan according to the present invention includes the hub, and the plurality of blades disposed radially on the circumference of the hub and having the blade muscles coupled to the hub, wherein the blades are formed so that a position of the trailing edge thereof has the waveform shape that gradually repeats the retraction and the advancement from the leading edge thereof, and are formed so that the chord length and the setting angle thereof are changed toward the longitudinal direction of the blades, and as a result, since the axial flow fan has a flow distribution having different angles in the longitudinal direction of an outlet of the air passing through the trailing edge, there is an advantage that the pressure distribution is dispersed and the noise is reduced.

In addition, since the axial flow fan according to the present invention has the flow distribution having the different angles, the flow guide path from the leading edge to the trailing edge is formed, thereby minimizing the flow from the hub to the longitudinal direction of the blades to thereby reduce the power consumption.

BEST MODEL

Hereinafter, an axial flow fan according to the present invention having the characteristics as described above will be described in detail with reference to the accompanying drawings.

Figure 1:
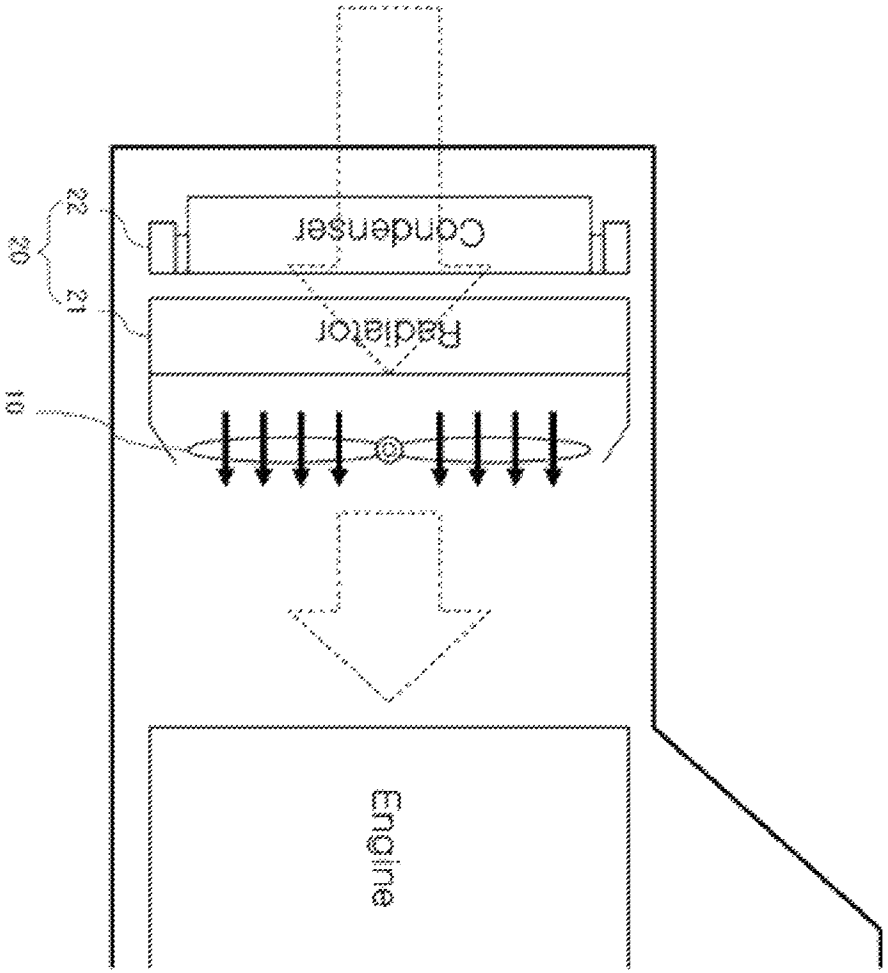
FIG. 1 is a view showing an arrangement of a general heat exchanger and an axial flow fan.
Figure 2:
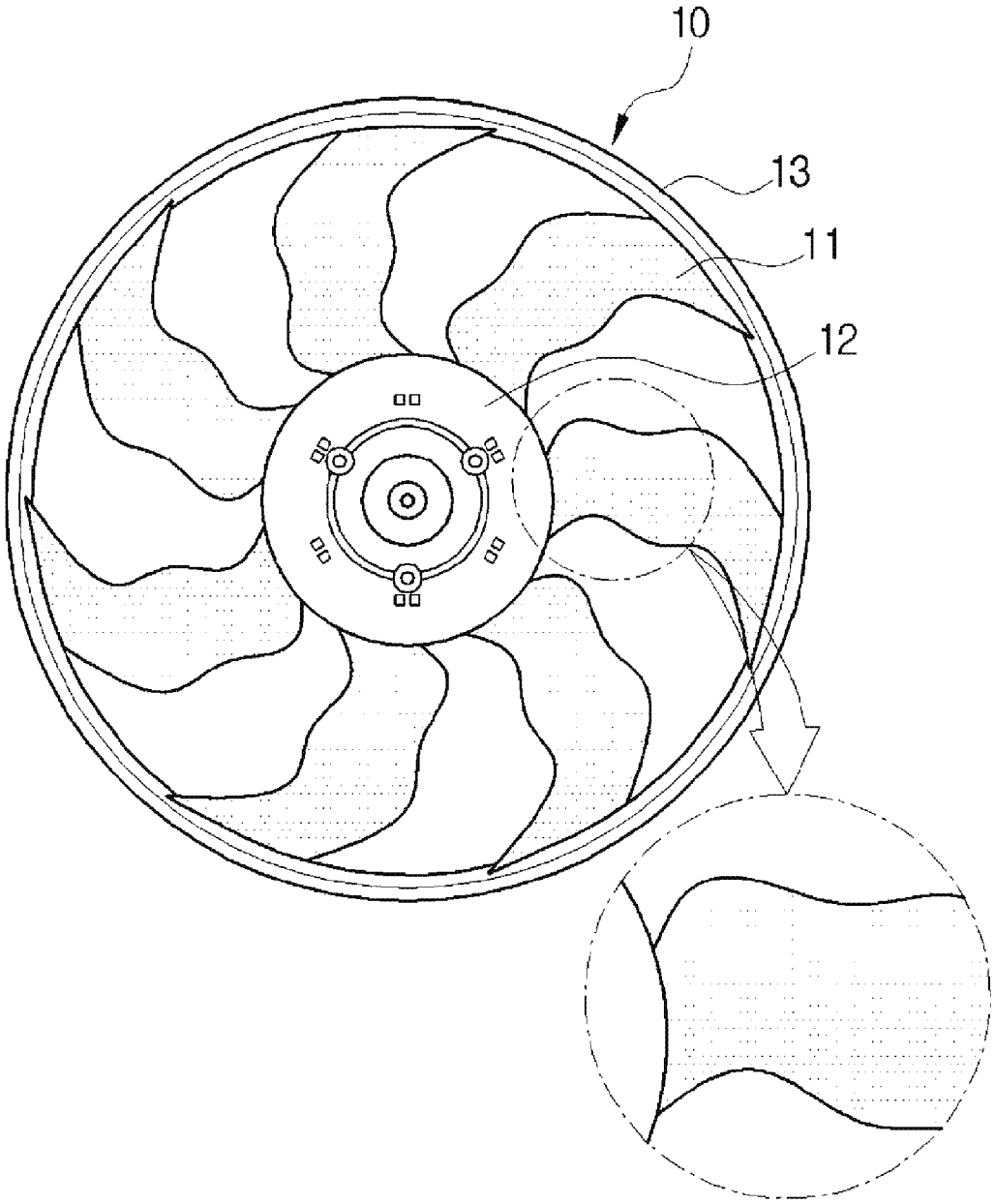
FIG. 2 is a view showing a general air flow fan.
Figure 3:
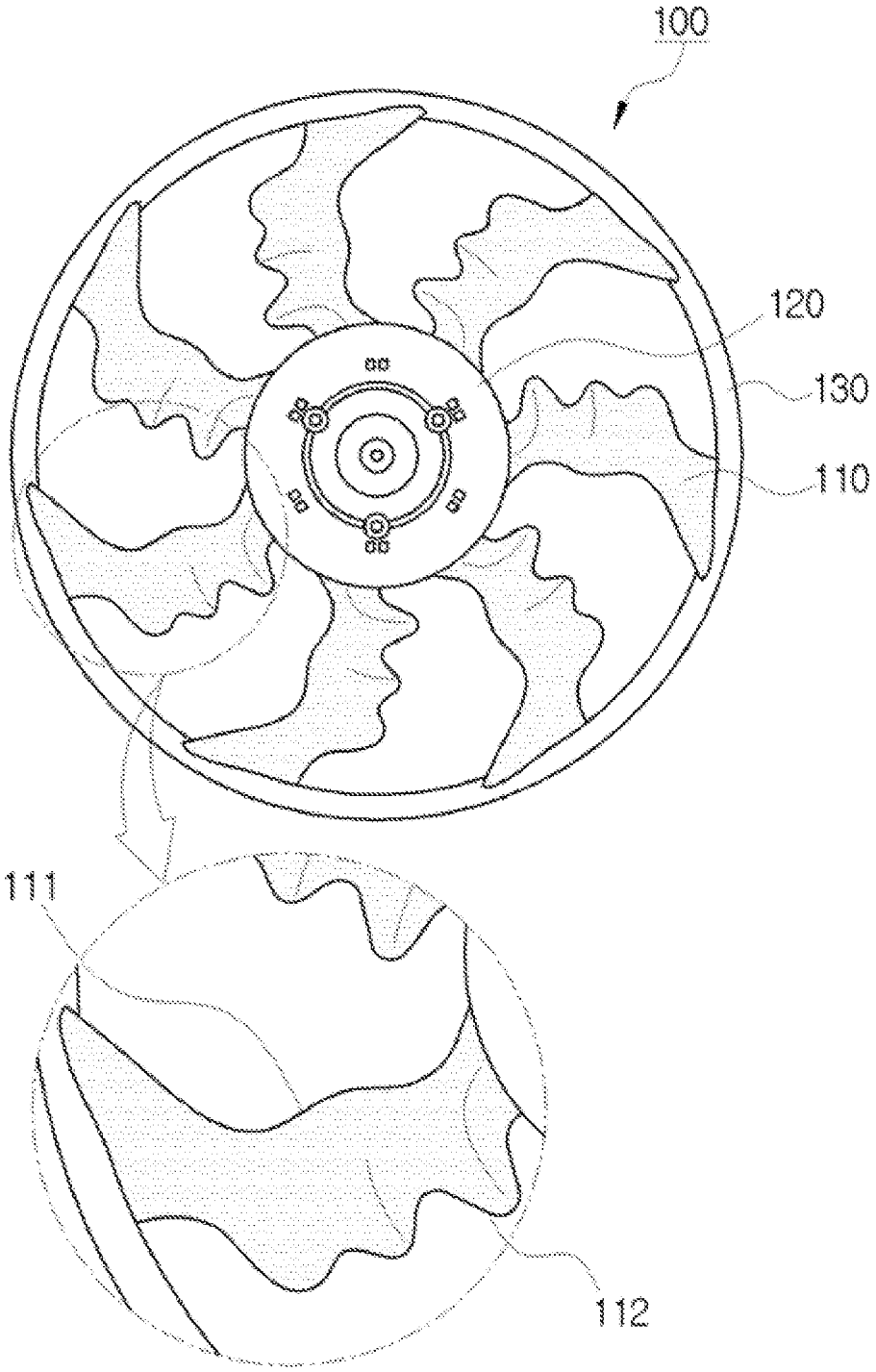
FIG. 3 is a view showing an axial flow fan according to the present invention.

FIG. 3 is a view showing an axial flow fan according to the present invention and FIG. 4 is a view comparing the axial flow fan according to the present invention and a conventional axial flow fan.

Figure 4A:
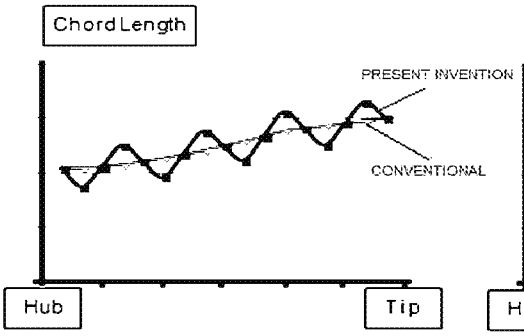
FIG. 4A is a view comparing the axial flow fan according to the present invention and a conventional axial flow fan as to the chord length.
Figure 4B:
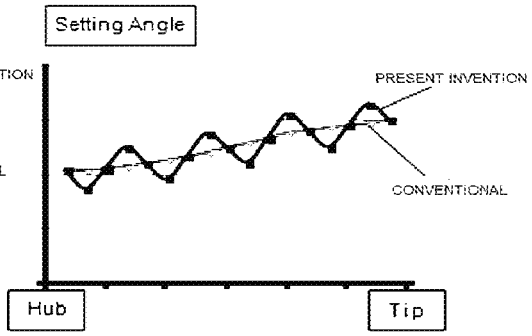
FIG. 4B is a view comparing the axial flow fan according to the present invention and a conventional axial flow fan as to the setting angle.

As shown in FIGS. 3, 4A and 4B, an axial flow fan 100 according to the present invention may be formed to include a hub 120 and blades 110, and may reduce noise and satisfy characteristics of an air volume without changing other configuration forms such as a shroud and the like by specifying forms including a chord length L and a setting angle α of the blades 110.

The hub 120 is a portion forming a central region of the axial flow fan 100, and a rotary shaft is connected to a center of the axial flow fan 100.

In addition, the hub 120 is seated with a fan motor for driving the axial flow fan 100.

A plurality of blades 110 are disposed radially on a circumference of the hub 120 and axially transfer air.

Meanwhile, the axial flow fan 100 according to the present invention may further include a fan band 130 formed in a disc form to connect the respective blade ends of the blades 110 to each other.

When the fan band 130 is further formed, overall structural safety of the axial flow fan 100 may be further increased.

Further, in the axial flow fan according to the present invention, a radial direction of the axial flow fan 100 is defined as a longitudinal direction.

The blade 110 includes a leading edge 111, which is a region that is first in contact with air according to a rotation direction, and a trailing edge 112, which is a region in which the air escapes to a side opposite to the leading edge 111.

Figure 7:
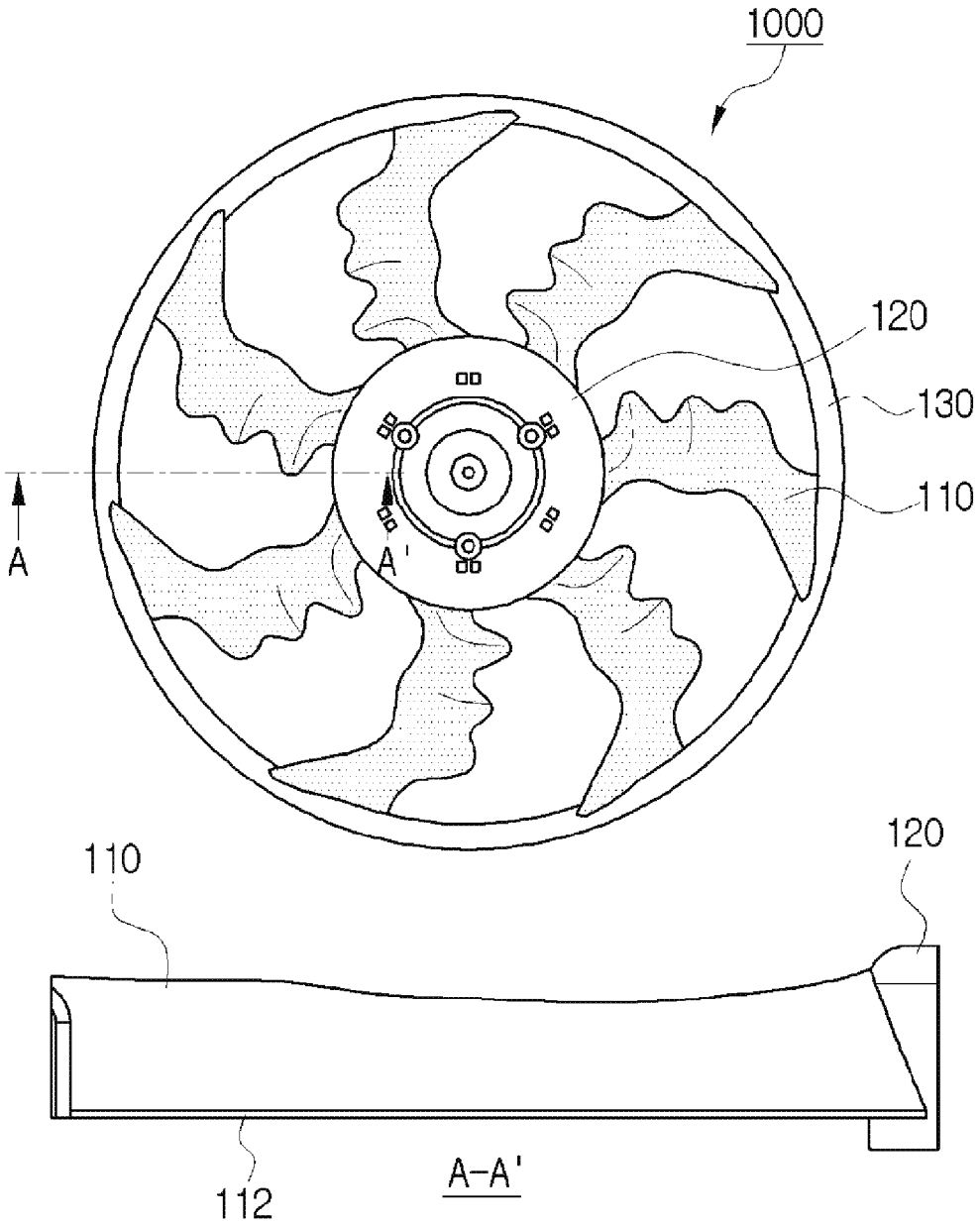
FIG. 7 is another view showing the axial flow fan according to the present invention.

The chord length L described above means a length obtained by connecting the leading edge 111 and the trailing edge 112 of the blade 110 by a straight line, and the setting angle α means an angle formed with a horizontal plane of the axial flow fan 100 at the trailing edge 112 (see FIG. 7).

The blade 110 of the axial flow fan 100 according to the present invention has a waveform form in which a position of the trailing edge 112 gradually repeats retraction and advancement from the leading edge 111 toward the longitudinal direction thereof.

Since the blade 110 has the waveform form in which the position of the trailing edge 112 thereof gradually repeats the retraction and advancement in the longitudinal direction, the position of the trailing edge 112 is continuously changed toward the longitudinal direction and the setting angle α is also continuously changed toward the longitudinal direction.

In this case, the chord length L of the blade 110 of the axial flow fan according to the present invention may be continuously changed toward the longitudinal direction, and to this end, the leading edge 111 and the trailing edge 112 may have the shapes in which the positions thereof are continuously changed toward the longitudinal direction.

As shown in FIG. 4A, in the case of the conventional axial flow fan, the chord length thereof is constantly formed in the longitudinal direction from the hub, while since the position of the trailing edge 112 of the blade 110 is formed in the waveform form, the axial flow fan 100 according to the present invention is formed in such a shape that the chord length L repeats lengthening and shortening according to the retraction and the advancement of the trailing edge 112.

Further, as shown on FIG. 4B, in the case of the conventional axial flow fan, a setting angle thereof is also gently formed corresponding to the chord length which is gently changed toward the longitudinal direction.

On the other hand, since the blade 110 of the axial flow fan 100 according to the present invention has the waveform form in which the chord length L from the leading edge 111 is different, the setting angle α is also formed to have the waveform form toward the longitudinal direction.

That is, in the blade 110 of the axial flow fan 100 according to the present invention, since the setting angle α of the trailing edge 112 that the air escapes from the blade 110 is formed to be different in the longitudinal direction, a flow of air is also distributed at different angles by the trailing edge 112 having different angles.

In other words, as the axial flow fan 100 has a flow distribution having different angles in the longitudinal direction of the outlet of air passing through the trailing edge 112, the axial flow fan 100 has an effect in which a pressure distribution is dispersed and noise is reduced.

In addition, as the flow of air is each distributed in a direction from the leading edge 111 to the trailing edge 112, a guide path in which the air flows is formed such that the air moves from the leading edge 111 to the trailing edge 112 along a guided flow path and escapes the blade 110.

Since this may minimizes the flow of air in the longitudinal direction in the hub 120, there is an effect in which power consumption is reduced.

In this case, it is preferable that the blade 110 reduces the noise by forming a plurality of flow paths of air, and is formed so that the waveform form of the trailing edge 112 is repeated at least twice or more toward the longitudinal direction in order to minimize the air flowing in the longitudinal direction in the hub 120, and it is possible to variously set the number of repetitions according to the longitudinal direction.

Figure 5:
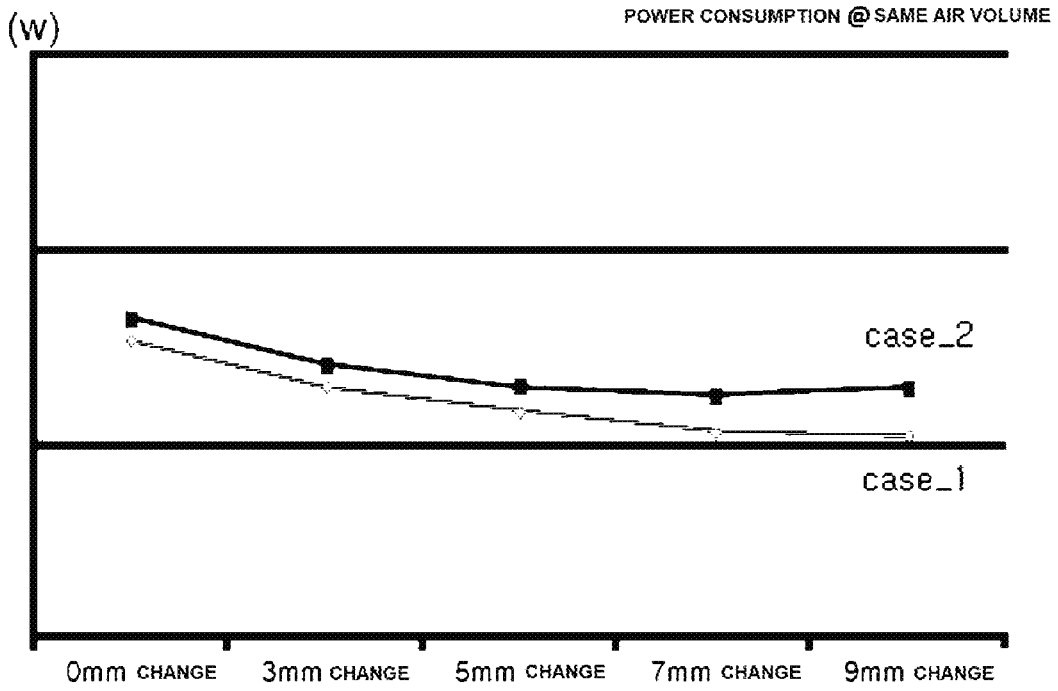
FIG. 5 is a view showing an analysis result of the axial flow fan according to the present invention.
Figure 6:
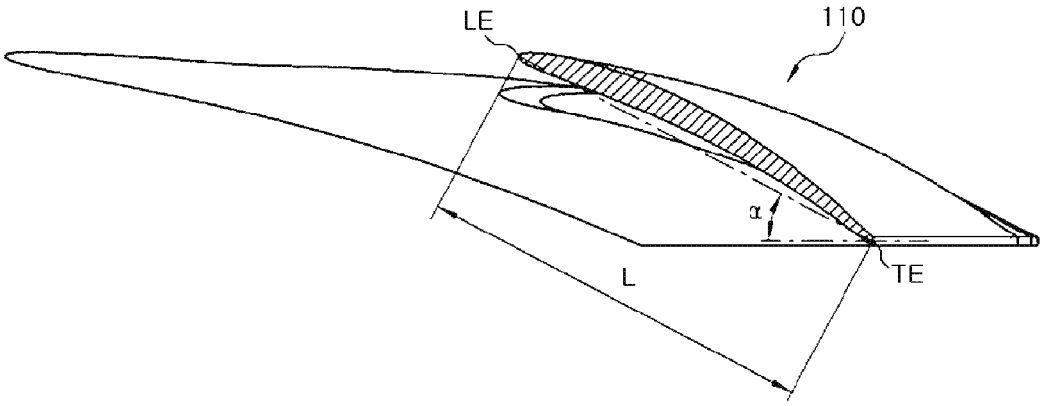
FIG. 6 is a view defining a chord length and a setting angle of the axial flow fan according to the present invention.

FIG. 5 is a view showing an analysis result of the axial flow fan according to the present invention.

As shown in FIG. 5, power consumption according to a length of the trailing edge 112 that retracts and advances from the leading edge 111 at the same air volume was analyzed based on two cases according to an operation of the axial flow fan 100 according to the present invention at the same air volume.

The axial flow fan 100 including the blade 110 including the trailing edge 112 having the waveform shape according to the present invention shows that the power consumption is reduced as the length of the trailing edge 112 that retracts and advances from the leading edge 111 is increased, and when the trailing edge 112 is retracted and advanced to a length of 7 mm from the leading edge 111, a result in which the power consumption is maximally reduced was produced.

However, when the length is increased from 8 mm to 9 mm, a result in which the power consumption of one case is increased was produced, and based on such a result, it is preferable that the blade 110 of the axial flow fan 100 according to the present invention is formed so that the trailing edge 112 is retracted and advanced in the range between 6 mm and 8 mm from the leading edge 111.

However, since the axial flow fan 100 may be variously formed depending on the size of the axial flow fan 100 and the place at which the axial flow fan 100 is installed, the axial flow fan 100 is not limited thereto.

Figures 8A, 8B:
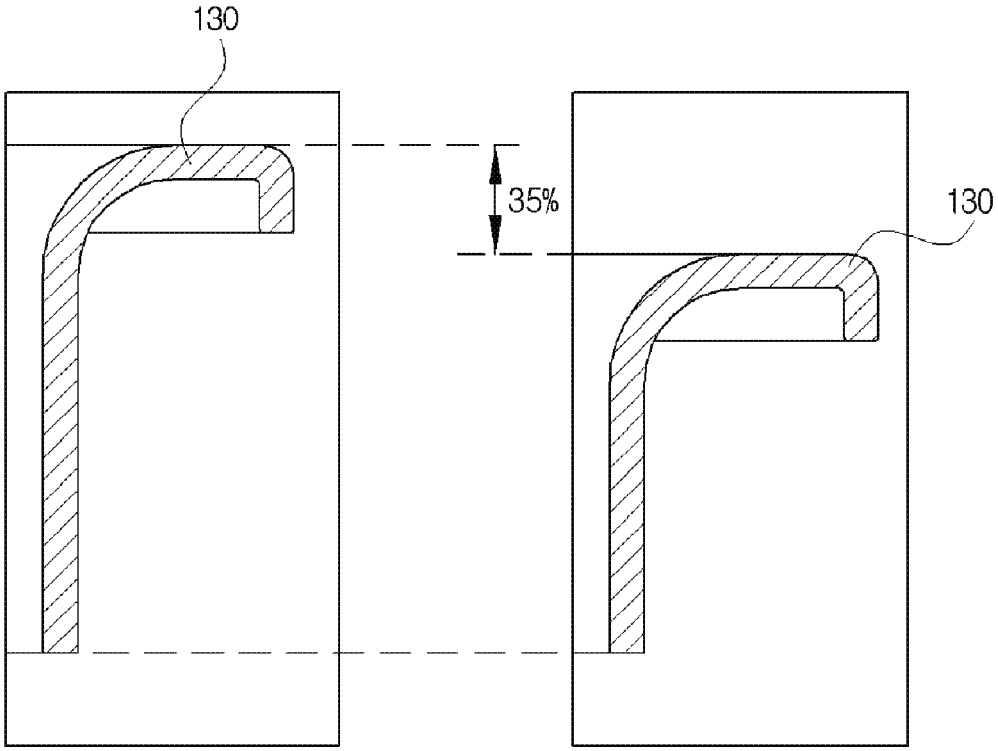
FIG. 8A is a view showing a fan band of the axial flow fan according to conventional invention.
FIG. 8B is a view showing a fan band of the axial flow fan according to the present invention.

FIG. 7 is another view showing the axial flow fan according to the present invention and FIG. 8B is a view showing a fan band of the axial flow fan according to the present invention.

As shown in FIG. 7, it is preferable that the blade 110 of the axial flow fan 100 according to the present invention is formed so that the trailing edge 112 of the blade 110 is positioned on the same plane in the longitudinal direction in the hub 120.

As shown in FIGS. 7, 8A and 8B, since the trailing edge 112 of the blade 110 is formed on the same plane at the time of advancing (raking) in the longitudinal direction, a height of the fan band 130 due to a repeated fluctuation of the height can be minimized.

As an example, as shown on FIG. 8B, by forming the trailing edge 112 so as to be positioned on the same plane in the longitudinal direction, the height of the fan band 130 may be reduced by 35% as compared with the conventional axial flow fan, and as a result, a result in which a weight of the axial flow fan 100 is reduced by 13.5% was produced.

Figure 9:
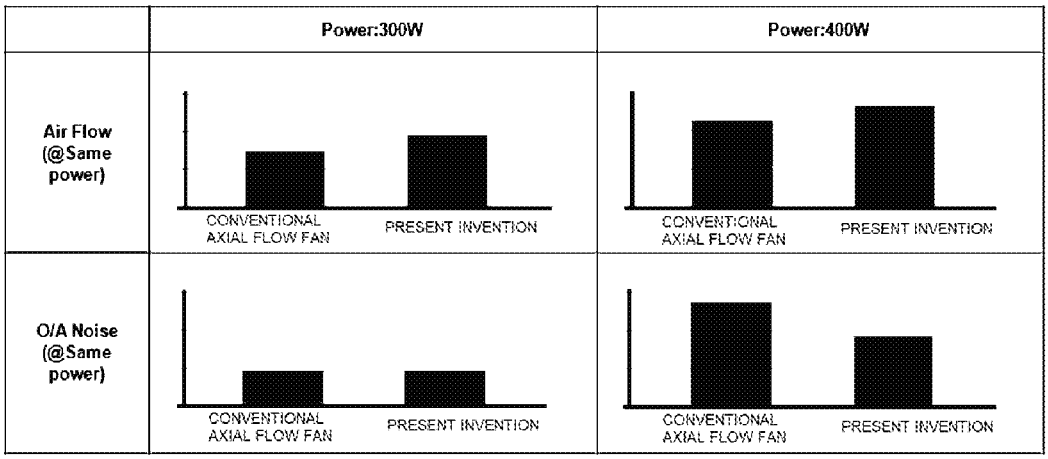
FIG. 9 is a view showing an effect of the axial flow fan according to the present invention.

As shown in FIG. 9, since the trailing edge 112 of the blade 110 of the axial flow fan 100 according to the present invention has the waveform shape that retracts and advances from the leading edge 111 and is formed to be repeated at least twice or more in the longitudinal direction, the flow path of air is differently distributed depending on the position of the trailing edge 112 and as a result, the noise may be reduced according to a dispersion of a pressure distribution, and since the guide path in which the air flows is formed according to the waveform shape of the trailing edge 112, the air flowing in the longitudinal direction in the hub 120 may be minimized and the power consumption may be reduced.

Accordingly, in the axial flow fan 100 according to the present invention, a result in which the air volume is increased and the noise is reduced is produced as compared with the conventional axial flow fan based on the same power consumption of 300 W and 400 W.

In addition, as described above, since the height of the fan band 130 may be formed to be reduced as compared with the conventional axial flow fan, a result in which the weight of the axial flow fan 100 is also reduced was produced.

The present invention is not limited to the above-mentioned embodiments, and may be variously applied, and may be variously modified without departing from the gist of the present invention claimed in the claims.

DESCRIPTION OF REFERENCE NUMERALS

100: axial flow fan
110: blade
111: leading edge
112: trailing edge
120: hub
130: fan band

The invention claimed is:

1. An axial flow fan including a hub, and a plurality of blades disposed radially on a circumference of the hub, each of the plurality of blades having one end coupled to the hub, wherein a radial direction of the axial flow fan is defined as a longitudinal direction, a length obtained by connecting a leading edge and a trailing edge of each blade is defined as a chord length, and an angle of the trailing edge of each blade with respect to a horizontal plane of the axial flow fan is defined as a setting angle $\alpha$, the trailing edge of each blade repeatedly retracts and advances in a gradual manner with respect to the leading edge in the longitudinal direction, such that the setting angle of the trailing edge is continuously changed in the longitudinal direction, and wherein the leading edge and the trailing edge repeatedly retract and advance in the longitudinal direction a number of times respectively, such that the number of times the trailing edge repeatedly retracts and advances is greater than the number of times the leading edge repeatedly retracts and advances, and each portion of the trailing edge along the longitudinal direction is positioned on a same horizontal plane perpendicular to a rotary shaft of the axial flow fan.

2. The axial flow fan of claim 1, wherein the chord length of each blade is continuously changed in the longitudinal direction.

3. The axial flow fan of claim 1, wherein the each blade is formed so that the trailing edge retracts and advances in a range between 6 mm and 8 mm from the leading edge.

4. The axial flow fan of claim 1, further comprising a fan band formed as a ring and connecting respective other ends of the plurality of blades to each other.

* * * * *